US005705474A

United States Patent [19]

Severns et al.

[11] Patent Number: 5,705,474

[45] Date of Patent: *Jan. 6, 1998

[54] RINSE ADDED FABRIC SOFTENER COMPOSITIONS CONTAINING SUNSCREENS FOR SUN-FADE PROTECTION FOR FABRICS

[75] Inventors: John Cort Severns, West Chester; Mark Robert Sivik, Fairfield; Ellen Schmidt Baker; Frederick Anthony Hartman, both of Cincinnati, all of Ohio

[73] Assignee: The Procter & Gamble Company, Cincinnati, Ohio

[ * ] Notice: The term of this patent shall not extend beyond the expiration date of Pat. No. 5,474,691.

[21] Appl. No.: 596,778

[22] Filed: Feb. 5, 1996

Related U.S. Application Data

[63] Continuation of Ser. No. 280,692, Jul. 26, 1994, abandoned.

[51] Int. Cl.[6] ..... C11D 7/32

[52] U.S. Cl. ..... 510/500; 510/500; 510/501; 510/502; 510/504; 510/505; 510/516; 510/522

[58] Field of Search ..... 510/516, 521, 510/522, 504, 499, 500, 501, 502, 505

[56] References Cited

U.S. PATENT DOCUMENTS

| | | | |
|---|---|---|---|
| 3,878,229 | 4/1975 | Strobel | 260/404.5 |
| 3,992,434 | 11/1976 | Oppelt et al. | 260/473 |
| 4,069,309 | 1/1978 | Ciaudelli et al. | 424/47 |
| 4,153,744 | 5/1979 | Remley | 427/160 |
| 4,339,503 | 7/1982 | Rukavina et al. | 428/412 |
| 4,629,682 | 12/1986 | Leppard et al. | 430/372 |
| 4,680,144 | 7/1987 | Conner | 260/501.15 |
| 4,788,054 | 11/1988 | Bernhardt et al. | 424/59 |
| 4,964,871 | 10/1990 | Reinert et al. | 8/115.59 |
| 4,986,922 | 1/1991 | Snow et al. | 252/8.8 |
| 5,134,223 | 7/1992 | Langer et al. | 528/272 |
| 5,143,729 | 9/1992 | Thompson | 424/402 |
| 5,185,088 | 2/1993 | Hartman et al. | 252/8.6 |
| 5,194,667 | 3/1993 | Oxenrider et al. | 560/87 |
| 5,243,021 | 9/1993 | Langer et al. | 528/272 |
| 5,250,652 | 10/1993 | Langer et al. | 528/125 |
| 5,374,362 | 12/1994 | McFarland | 252/8.6 |

FOREIGN PATENT DOCUMENTS

| | | |
|---|---|---|
| 309052 | 9/1987 | European Pat. Off. . |
| 0 374 751 A2 | 12/1988 | European Pat. Off. . |
| 295739 | 12/1988 | European Pat. Off. . |
| 1124694 | 5/1989 | Japan . |
| 1124695 | 5/1989 | Japan . |
| 2 081 716 | 2/1982 | United Kingdom . |
| 2392 | 10/1984 | WIPO . |
| 0 165 710 A1 | 12/1985 | WIPO . |
| 0 272 576 A1 | 6/1988 | WIPO . |
| 0 273 011 A2 | 6/1988 | WIPO . |
| 0 374 751 A2 | 6/1990 | WIPO . |
| 0 523 953 A2 | 1/1993 | WIPO . |
| 0 523 955 A2 | 1/1993 | WIPO . |

OTHER PUBLICATIONS

Textile Chemist and Colorist, "Evaluating UV Absorbers for Museum Textiles", Nov. 1987, vol. 19, No. 11.

Polymer Degradation and Stability 10, "Ultraviolet Absorbers for Retarding Wool Photodegradation: Sulphonated 2–Hydroxybenzphenones and 2,2'–Dihydroxybenzophenones", (1985), pp. 335–352 No month available .

Cosmetics and Toiletries, "Encyclopedia of UV Absorbers for Sunscreen Products", vol. 107, Oct. 1992, pp. 45–64.

*Primary Examiner*—Paul Lieberman
*Assistant Examiner*—John R. Hardee
*Attorney, Agent, or Firm*—Robert B. Aylor

[57] ABSTRACT

The present invention relates to fabric care compositions to reduce the fading of fabrics from sunlight, comprising;

(A) from about 1% to about 25% by weight of the composition, of a non-fabric staining, light stable sunscreen compound preferably containing at least one $C_8$–$C_{22}$ hydrocarbon fatty organic moiety;

(B) from 3% to about 50% by weight of a fabric softening compound; and (C) from about 25% to about 95% by weight of a carrier material; wherein the sunscreen compound absorbs light at a wavelength of from about 290 nm to about 450 nm; wherein the sunscreen compound is a solid material having a melting point of from about 25° C. to about 90° C. or a viscous liquid at a temperature of less than about 40° C.

13 Claims, No Drawings

RINSE ADDED FABRIC SOFTENER COMPOSITIONS CONTAINING SUNSCREENS FOR SUN-FADE PROTECTION FOR FABRICS

CROSS-REFERENCE TO RELATED APPLICATION

This application is a file wrapper continuation of our application Ser. No. 08/280,692, filed Jul. 26, 1994 now abandoned.

TECHNICAL FIELD

The present invention relates to fabric care compositions comprising non-fabric staining, light stable, sunscreen compounds to reduce the fading of fabrics from sunlight. The sunscreen compounds absorb light at a wavelength of from about 290 nm to about 450 nm and are either solids having a melting point of from about 25° C. to about 90° C. or viscous liquids is at a temperature of less than about 40° C. Preferably the fabric care compositions are fabric softening compositions.

BACKGROUND OF THE INVENTION

Consumers worldwide experience color damage to their clothing from exposure to the sun during drying and during wear especially for those consumers living in tropical and subtropical climates. Despite extensive efforts by the textile industry to develop light stable dyes and after-treatments to improve light-fastness of dyes, the fading of clothing still remains a problem.

It is now discovered that visible light is responsible for a significant amount of dye fading on clothing. For example, visible light has a higher contribution to light fading than UV-A (315–400 nm), which has a higher contribution to light fading than UV-B (290–315 nm). Because the absorption spectrum of sunscreen compounds of the present invention broadly absorbs UVA, these agents provide broader sun-fade fabric protection with fewer problems that are associated with the conventional sunscreens.

The incorporation of sunscreens into fabric care compositions for various benefits is known in the art. JP 63/162,798, Lion, teaches the use of sunscreens to stabilize the color of fabric softening compositions. EPA 272,576, L. Givaudan & CIE Société, teaches fabric care, skin care and hair care compositions containing quaternary ammonium salts of cinnamate esters as sunscreens. This reference teaches that substantivity on hair, skin and fabric increases when a long chain alkyl group is attached to the quaternary nitrogen. U.S. Pat. No. 5,134,223, Langer et al., issued Jul. 28, 1992, Lever, covers copolymers with a UV-absorbing monomer and a hydrophilic monomer to provide both anti-fading and soil release benefits. This reference teaches the combination of a polymer of UV-absorbing monomers to a soil release polymer consisting of a hydrophilic group (e.g. ethoxylate) and hydrophobic group (e.g. terephthalate blocks). U.S. Pat. No. 5,250,652, Langer et al., issued Oct. 5, 1993, Lever, teaches copolymers containing at least one UVA light-absorbing moiety and/or one UVB light-absorbing moiety, one low molecular weight (i.e., monomeric) hydrophilic moiety, and optionally one hydrophobic moiety for fabric care (detergents, LDLs, fabric softeners) and skin care applications (cosmetics, shampoos, sunscreens, personal cleansing compositions, etc.). The use of the low molecular weight hydrophilic moieties allows a loading of UVA and/or UVB moieties of up to about 95% and provides better dispersibility of the polymer in an aqueous media. The optional hydrophobic moiety provides control over the deposition of the copolymer on a desired surface.

Attempts, thus far, to minimize or eliminate the fading of fabrics from the sun via a fabric care composition have been unsatisfactory due to higher cost, the difficulty of providing broad spectrum protection, formulation difficulties, etc.

Therefore, an object of the present invention is to provide a fabric care composition with a sunscreen compound, effective at low levels, which will reduce the rate of sun-fading of clothing with a variety of fabric types.

Therefore, it is a further object of the present invention to provide a delivery system to efficiently deposit and to efficiently distribute sunscreen compounds, which are effective at low levels, on clothing.

Therefore, it is a further object of the present invention to provide sunscreen compounds which are stable in the delivery system to efficiently deposit and to effectively distribute sunscreen compounds on clothing.

Therefore, it is a further object of the present invention is to provide a convenient way for the consumer to reduce the rate of sun-fading of clothing by treating the clothing with softening compositions containing sunscreen compounds during the rinse cycle of the laundering process.

All of the above patents and patent applications are incorporated herein by reference.

SUMMARY OF THE INVENTION

The present invention relates to fabric care compositions to reduce the fading of fabrics from sunlight, comprising;

(A) from about 1% to about 25% by weight of the composition, of a non-fabric staining, light stable, sunscreen compound preferably containing at least one $C_8$–$C_{22}$ hydrocarbon fatty organic moiety;

(B) from 3% to about 50% by weight of a fabric softening compound; and (C) from about 25% to about 95% by weight of a carrier material;

wherein the sunscreen compound absorbs light at a wavelength of from about 290 nm to about 450 nm; wherein the sunscreen compound is a solid having a melting point of from about 25° C. to about 90° C. or a viscous liquid at a temperature of less than about 40° C.

The compositions of the present invention deposit onto fabric from about 0.5 mg/g fabric to about 5 mg/g fabric of sun-fade active to reduce the sun fading of fabric. Surprisingly, compositions of the present invention will deposit these levels on fabrics, containing fairly low levels of sunscreen compounds (i.e. from about 3% to about 15%).

All percentages and ratios used herein are by weight of the total composition. All measurements made are at 25° C., unless otherwise designated. The invention herein can comprise, consist of, or consist essentially of, the essential components as well as the optional ingredients and components described herein.

DETAILED DESCRIPTION OF THE INVENTION

(A) Sunscreen Compounds

The present invention relates to fabric care compositions to reduce the fading of fabrics from sunlight, comprising from about 1% to about 25%, preferably from about 2% to about 20%, more preferably from about 3% to about 15%, by weight of the composition, of a non-fabric staining, light stable sunscreen compound preferably containing at least one $C_8$–$C_{22}$ hydrocarbon fatty organic moiety, wherein the sunscreen compound absorbs light at a wavelength of from about 290 nm to about 450 nm; wherein the sunscreen compound is a solid having a melting point of from about 25° C. to about 90° C. or a viscous liquid at a temperature of less than about 40° C. More preferably the sunscreen compound contains at least one $C_{12}$–$C_{18}$ hydrocarbon fatty organic moiety.

Preferably the sunscreen compound absorbs light at a wavelength of from about 315 nm to about 400 nm and is a solid having a melting point of from about 25° C. to about 75° C. or a viscous liquid at a temperature of less than about 40° C.

More preferably the sunscreen compound is a solid having a melting point of from about 25° C. to about 50° C. or a viscous liquid at a temperature of less than about 40° C.

The compositions of the present invention deposit from about 0.5 mg/g fabric to about 5 mg/g fabric of sun-fade active onto fabric to reduce the sun fading of fabric. Surprisingly, compositions of the present invention containing fairly low levels of sunscreen compounds (i.e. from about 3% to about 15%) will deposit these levels on fabric. This minimizes the cost of the composition.

Preferably these sunscreen compounds contain at least one chromophore selected from the group consisting of:

(I)

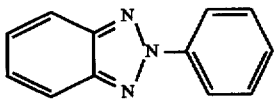

Phenylbenzotriazole (II)

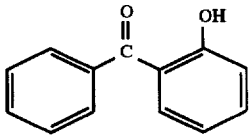

2-Hydroxybenzophenone (III)

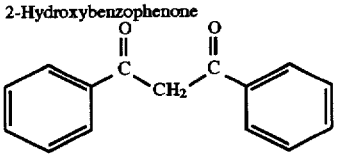

Dibenzoylmethane (IV)

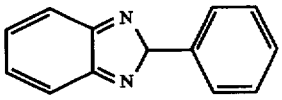

Phenylbenzimidazole (V)

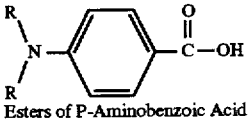

Esters of P-Aminobenzoic Acid (PABA)

(VI)

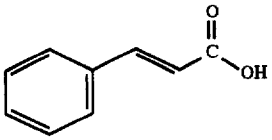

Esters of Cinnamic Acid

-continued (VII)

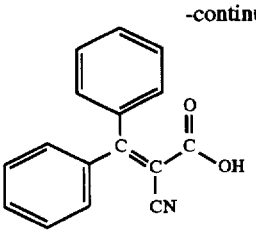

Esters of 2-Cyano-3, 3-diphenyl-2-Propenoic Acid (VIII)

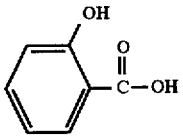

Esters of Salicylic Acid and (IX)

mixtures thereof;

wherein each R is a hydrogen, methyl, ethyl, $C_1$ to $C_{22}$ branched or straight chain alkyl group and mixtures thereof, preferably a methyl group; and wherein the compound containing the chromophore is a non-fabric staining, light stable compound containing preferably at least one $C_8$–$C_{22}$ hydrocarbon fatty organic moiety; wherein the chromophore absorbs light at a wavelength of from about 290 nm to about 450 nm; wherein the compound is a solid having a melting point of from about 25° C. to about 90° C. or a viscous liquid at a temperature of less than about 40° C.

Preferably the sunscreen compound is a compound containing at least one chromophore selected from the group consisting of (I), (II), (III), (IV), (V), (VII), (VIII), and mixtures thereof; more preferably the sunscreen compound is a compound containing at least one chromophore selected from the group consisting of (I), (II), (III), (IV), and mixtures thereof; and even more preferably (I), (II), and mixtures thereof. Furthermore, compounds containing at least one formula (I) chromophore are especially preferred.

More preferably these sunscreen compounds are selected from the group consisting of:

(I)

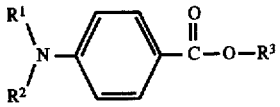

(II)

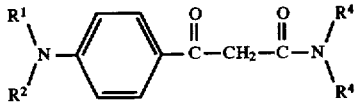

(III)

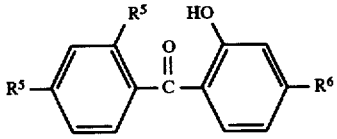

(IV)

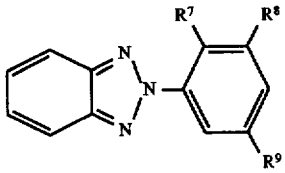

-continued (V)

mixtures thereof;

wherein $R^1$ is a hydrogen or a $C_1$ to $C_{22}$ alkyl group; preferably a hydrogen or a methyl group;

$R^2$ is a hydrogen or a $C_1$ to $C_{22}$ alkyl group; preferably a hydrogen or methyl group;

$R^3$ is a $C_1$ to $C_{22}$ alkyl group; preferably a $C_8$ to $C_{18}$ alkyl group; more preferably a $C_{12}$ to $C_{18}$ alkyl group;

each $R^4$ is a hydrogen, a $C_1$ to $C_{22}$ alkyl group, and mixtures thereof; preferably a methyl group, a $C_8$ to $C_{22}$ alkyl group, and mixtures thereof, more preferably one $R^4$ is a $C_{10}$ to $C_{20}$ alkyl group, preferably a $C_{12}$ to $C_{18}$ alkyl group, and the other $R^4$ group is a methyl group;

each $R^5$ is a hydrogen, hydroxy group, a $C_1$ to $C_{22}$ alkyl group, (which can be an ester, amide, or ether interrupted group), and mixtures thereof, preferably a hydrogen, hydroxy group, and mixtures thereof, more preferably hydrogen;

$R^6$ is a hydrogen, hydroxy group, methoxy group, a $C_1$ to $C_{22}$ alkyl group, (which can be an ester, amide, or ether interrupted group), and mixtures thereof, preferably a $C_1$ to $C_{22}$ alkyl group with an ether or ester interrupted group, and mixtures thereof, more preferably a methoxy group, a $C_8$ to $C_{22}$ alkyl group with an ester interrupted group, and mixtures thereof;

$R^7$ is a hydrogen, hydroxy group, or a $C_1$ to $C_{20}$ alkyl group, preferably a hydrogen or a hydroxy group, more preferably a hydroxy group;

$R^8$ is a hydrogen, hydroxy group, or a $C_1$ to $C_{22}$ alkyl group, (which can be an ester, amide, or ether interrupted group); preferably a $C_1$ to $C_{22}$ alkyl group; more preferably a $C_1$ to $C_8$ alkyl group, and even more preferably a methyl group, a "tert"-amyl group, or a dodecyl group;

$R^9$ is a hydrogen, hydroxy group, or a $C_1$ to $C_{22}$ alkyl group, (which can be an ester, amide, or ether interrupted group); preferably a "tert"-amyl, methyl phenyl group, or a coco dimethyl butanoate group.

The sunscreen compounds of the present invention absorb light at a wavelength of from about 290 nm to about 450 nm, preferably from about 315 nm to about 400 nm.

In the compositions of the present invention, $R_5$, $R_6$, $R_7$, $R_8$, and $R_9$ can be interrupted by the corresponding ester linkage interrupted group with a short alkylene ($C_1$–$C_4$) group.

The physical properties of the sunscreen compound affects both compatibility with the softener compound and efficacy on the fabrics. Therefore, not all sunscreen agents (i.e. commercially available sunscreens) provide activity. Derivatization of known sunscreen structures with a $C_8$–$C_{22}$ fatty hydrocarbon chain typically reduces the melting point of the sunscreen agent which allows better incorporation into the softener matrix and better deposition and performance on fabric.

Preferred sunscreen agents of the present invention are selected from the group consisting of fatty derivatives of PABA, benzophenones, cinnamic acid, and phenyl benzotriazoles, specifically, octyl dimethyl PABA, dimethyl PABA lauryl ester, dimethyl PABA oleoyl ester, benzophenone-3 coco acetate ether, benzophenone-3 available under the tradename Spectra-Sorb® UV-9 from Cyanamid, 2-(2'-Hydroxy-3', 5'-di-tert-amylphenyl benzotriazole which is available under the tradename Tinuvin® 328 from Ciba-Geigy, Tinuvin® coco ester 2-(2'-Hydroxy, 3'-(coco dimethyl butanoate)-5'-methylphenyl) benzotriazole, and mixtures thereof. Preferred sunscreens agents of the present invention are benzotriazole derivatives since these materials absorb broadly throughout the UV region. Preferred benzotriazole derivatives are selected from the group consisting of 2-(2'-Hydroxy, 3'-dodecyl, 5'-methylphenyl) benzotriazole available under the tradename Tinuvin®571 (Ciba) available from Ciba-Geigy, and Coco 3-[3'-(2H-benzotriazol-2'-yl)-5-tert-butyl-4'-hydroxyphenyl]propionate.

The sunscreen agents of the present invention demonstrate light stability in the compositions of the present invention. "Light stable" means that the sunscreen compounds in the compositions of the present invention do not decompose when exposed to either sunlight or simulated sunlight for approximately 2 to 60 hours at a temperature of from about 25° C. to about 45° C.

The composition of the present invention deposits from about 0.5 mg/g fabric to about 5 mg/g fabric of the sun-fade actives to reduce the sun fading of the fabric.

Treatment of fabric with compositions of the present invention repeatedly during the rinse cycle of a typical laundering process, may result in higher deposition levels, which contributes even further to the sun-fading benefit.

Conventional sunscreens are generally less suitable for application to fabric because they less effectively deposit on surfaces, they sometimes discolor fabrics, they are not always stable or compatible with other components in the composition, and they are often expensive.

(B) Fabric Softening Compounds

The present invention also comprises, a fabric softening compound at a level of from about 3% to about 50%, preferably from about 6% to about 32%, and more preferably from about 8% to about 26%, even more preferably from about 15% to about 26%, by weight of the composition. The fabric softening compound is selected to minimize any adverse interaction with the antioxidant compound and optional sunscreen compound.

Some preferred fabric softening compounds are diester quaternary ammonium material (hereinafter referred to as "DEQA"). Two primary types of DEQA are preferred.

1. The first type of DEQA comprises, compounds of the formula:

$$[(R^7)_{4-p}-\overset{+}{N}+(CH_2)_{q^2}-(Y')-R^8]_p]\,X^- \quad (1)$$

wherein each Y' is —O—(O)C—, or —C(O)—O—; preferably —O—(O)C—;

p is 2 or 3; preferably 2;

each $q^2$ is 1 to 5, preferably 2;

each $R^7$ substituent is a shod chain $C_1$–$C_6$, preferably $C_1$–$C_3$ alkyl or hydroxyalkyl group, e.g., methyl (most preferred), ethyl, propyl, hydroxyethyl, and the like, benzyl group and mixtures thereof;

each $R^8$ is a long chain $C_{11}$–$C_{21}$ hydrocarbyl, or substituted hydrocarbyl substituent, preferably $C_{15}$–$C_{19}$ alkyl or alkylene, most preferably $C_{15}$–$C_{17}$ straight chain alkyl or alkylene such that the Iodine Value (hereinafter referred to as IV) of the parent fatty acid of this $R^8$ group is from about 5 to about 100;

and counterion, $X^-$, can be any softener-compatible anion, preferably the anion of a strong acid, for example, chloride, bromide, methylsulfate, formate, sulfate, nitrate and the like.

The anion can also, but less preferably, carry a double charge in which case $X^-$ represents half a group. These materials containing a divalent anion, in general, are more difficult to formulate as stable concentrated liquid compositions.

Any reference to Iodine Values hereinafter refers to the Iodine Value of the parent fatty acid groups, and not the resulting DEQA compound.

It will be understood that substituents $R^7$ and $R^8$ can optionally be substituted with various groups such as alkoxyl or hydroxyl groups, and can be straight, or branched so long as the groups maintain their basically hydrophobic character. The preferred compounds can be considered to be diester variations of ditallow dimethyl ammonium chloride (hereinafter referred to as "DTDMAC"), which is a widely used fabric softener. At least 80% of the DEQA is in the diester form, and from 0% to about 20% can be DEQA monoester (e.g., only one $-Y-R^8$ group).

As used herein, when the diester is specified, it can include the monoester that is present. For softening, under no/low detergent carry-over laundry conditions the percentage of monoester should be as low as possible, preferably no more than about 2.5%. However, under high, anionic detergent surfactant or detergent builder carry-over conditions, some monoester can be preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in manufacturing the DEQA.

The above compounds, used as the softening material in the practice of this invention, can be prepared using standard reaction chemistry. In one synthesis of a diester variation of DTDMAC, an amine of the formula $R^7N(CH_2CH_2OH)_2$ is esterified at both hydroxyl groups with an acid chloride of the formula $R^8C(O)Cl$, then quaternized with an alkyl halide, RX, to yield the desired reaction product (wherein $R^7$ and $R^8$ are as defined hereinbefore). However, it will be appreciated by those skilled in the chemical arts that this reaction sequence allows a broad selection of agents to be prepared. The following are non-limiting examples (wherein all long-chain alkyl substituents are straight-chain):

Saturated $$[HO-CH(CH_3)CH_2][CH_3]N^+[CH_2CH_2O(O)C-C_{15}H_{31}]_2\ Br^-$$

$$[C_2H_5]_2N^+[CH_2CH_2O(O)C-C_{17}H_{35}]_2\ Cl^-$$

$$[CH_3][C_2H_5]N^+[CH_2CH_2O(O)C-C_{13}H_{27}]_2\ I^-$$

$$[C_3H_7][C_2H_5]N^+[CH_2CH_2O(O)C-C_{15}H_{31}]_2\ [SO_4CH_3]^-$$

$$\begin{array}{l}[CH_3]_2N^+-CH_2CH_2O(O)C-C_{15}H_{31}Cl^- \\ \quad\ \ |\\ \quad\ CH_2CH_2O(O)C-C_{17}H_{35}\end{array}$$

$$[CH_2CH_2OH][CH_3]N^+[CH_2CH_2O(O)C-R^8]_2Cl^-$$

$$[CH_3]_2N^+[CH_2CH_2O(O)C-R^8]_2Cl^-$$

where —O—(O)C-$R^8$ is derived from hardened tallow fatty acid.

Unsaturated $$[HO-CH(CH_3)CH_2][CH_3]N^+[CH_2CH_2O(O)C-C_{15}H_{29}]_2.Br^-$$

$$[C_2H_5]_2N^+[CH_2CH_2O(O)C-C_{17}H_{33}]_2Cl^-$$

$$[CH_3][C_2H_5]N^+[CH_2CH_2O(O)C-C_{13}H_{25}]_2I^-$$

$$[C_3H_7][C_2H_5]N^+[CH_2CH_2O(O)C-C_{15}H_{24}]_2\ [SO_4CH_3]^-$$

$$\begin{array}{l}[CH_3]_2N^+-CH_2CH_2O(O)C-C_{15}H_{29}Cl^- \\ \quad\ \ |\\ \quad\ CH_2CH_2O(O)C-C_{17}H_{33}\end{array}$$

$$[CH_2CH_2OH][CH_3]N^+[CH_2CH_2O(O)C-R^8]_2\ Cl^-$$

$$[CH_3]_2N^+[CH_2CH_2O(O)C-R^8]_2Cl^-$$

where —O—(O)C-$R^8$ is derived from partially hydrogenated tallow or modified tallow having the iodine value set forth herein.

2. A second type of DEQA has the general formula:

$$\left[\begin{array}{l}R^8-(Y')-CH_2-\underset{\underset{\underset{R^8}{|}}{(Y')}}{\underset{|}{CH}}-CH_2-\overset{+}{N}-(R^7)_3\end{array}\right]X^- \qquad (2)$$

wherein each Y', $R^7$, $R^8$, and $X^-$ have the same meanings as before for DEQA (1). Such compounds include those having the formula:

$$[CH_3]_3N^+[CH_2CH(CH_2O(O)C\text{-}R^8)O(O)C\text{-}R^8]Cl^-$$

where —O—(O)C-$R^8$ is derived from hardened tallow fatty acid.

Preferably each $R^7$ is a methyl or ethyl group, and preferably each $R^8$ is in the range of $C_{15}$ to $C_{19}$ straight chain alkyl or alkylene group. Degrees of branching and substitution can be present in the alkyl chains. As used herein, when the diester is specified, it can include the monoester that is present. The amount of monoester that may be present is the same as in DEQA (1).

A specific example of a diester quaternary ammonium compound suitable for use in this invention herein includes:

1,2-ditallowyloxy-3-(trimethylammonio)propane chloride.

Other examples of suitable diester quaternary ammoniums of this invention are obtained by, e.g.: replacing "tallowyl" in the above compounds with, for example, cocoyl, palmoyl, lauryl, oleoyl, stearyl, palmityl, or the like; replacing "methyl" in the above compounds with ethyl, propyl, isopropyl, butyl, isobutyl, t-butyl, benzyl, or the hydroxy substituted analogs of these radicals; replacing "chloride" in the above compounds with bromide, methylsulfate, formate, sulfate, nitrate, and the like.

In fact, the anion is merely present as a counterion of the positively charged quaternary ammonium compounds disclosed herein. The scope of this invention is not considered limited to any particular anion.

The materials herein can be prepared by standard esterification and quaternization reactions, using readily available starting materials. General methods for preparation are disclosed in U.S. Pat. No. 4,137,180, Naik et al., issued Jan. 30, 1979, which is incorporated herein by reference.

The present invention may also contain mixtures of DEQA (1) and DEQA (2).

3. Other preferred fabric softening compounds are Di(2-amidoethyl)methyl quaternary ammonium salts, especially those having the formula:

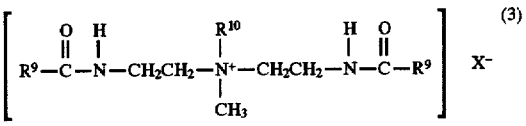

(3)

wherein each $R^9$ is a $C_8$ to $C_{20}$ alkyl or alkenyl group, preferably $C_{14}$–$C_{18}$ alkyl group; $R^{10}$ is a hydrogen methyl, ethyl, or $(C_rH_{2r}O)_sH$, preferably $(C_rH_{2r}O)_sH$; wherein r is from 1 to 5, preferably 2, wherein s is from 1 to 5, preferably 3, and, $X^-$ has the same meaning as before for formula DEQA (1). This class of agents is disclosed in U.S. Pat. No. 4,134,840, Minegishi et al., issued Jan. 16, 1979, U.S. Pat. No. 4,439,335, Burns, issued Mar. 27, 1984, and U.S. Pat. No. 4,767,547, Straathof et al., issued Aug. 30, 1988, all of which are incorporated herein by reference in their entirety.

Exemplary materials are di((2-hydrogenatedtallowamidoethyl) ethoxylated (2 ethoxy groups) methylammonium methylsulfate, di(2-oleoylamidoethyl) propoxylated (3-propoxy groups) methyl ammonium bromide, di(2-palmitoleoylamidoethyl) dimethyl ammonium ethylsulfate and di(2-stearylamidoethyl) propoxylated (2 propoxy groups) methyl ammonium methylsulfate.

An exemplary commercial material suitable for use as the fabric softening compound (3) herein is di(2-tallowamidoethyl) ethoxylated methyl ammonium methylsulfate sold under the name Varisoft® 222, from Witco Chemical Company.

Tallow is a convenient and inexpensive source of long chain alkyl and alkenyl materials.

4. A further softening material suitable for use in the composition of this invention has the formula:

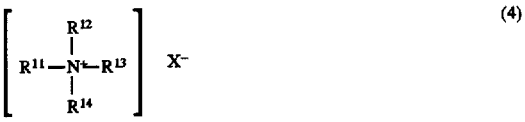

(4)

wherein each $R^{11}$ and $R^{12}$ is a $C_8$–$C_{24}$ alkyl or alkenyl group, preferably a $C_{12}$–$C_{18}$ alkyl group;

each $R^{13}$ and $R^{14}$ is a $C_1$–$C_6$ alkyl group, preferably a $C_1$–$C_3$ alkyl group;

X' is any anion as discussed hereinbefore for DEQA (1), preferably selected from halide, methyl sulfate, and ethyl sulfate.

Representative examples of the quaternary softeners include ditallow dimethyl ammonium chloride; ditallow dimethyl ammonium methyl sulfate; dihexadecyl dimethyl ammonium chloride; di(hydrogenated tallow alkyl) dimethyl ammonium chloride. A more complete description and general methods of making these compounds can be found in U.S. Pat. No. 4,401,578, Verbruggen et al., issued Aug. 30, 1983, U.S. Pat. No. 4,439,335, Burns, issued Mar. 27, 1984, and U.S. Pat. No. 4,923,642, Rutzen et al., issued May 8, 1990, all of which are incorporated herein by reference in their entirety.

5. Another preferred fabric softening material is a substituted imidazoline fabric softener material having the formula:

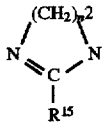

(5)

wherein each $Y^2$ is either: —$N(R^{16})C(O)$—, in which each $R^{16}$ is selected from the group consisting of $C_1$—$C_6$ alkyl, alkenyl, or hydroxy alkyl group, or hydrogen; —OC(O)—; or a single covalent bond; wherein each $R^{15}$ is independently, a hydrocarbyl, preferably alkyl, group containing from about 11 to about 31, preferably from about 13 to about 17, carbon atoms, more preferably a straight chain alkyl group, and wherein each $n^2$ independently is from 2 to 4, preferably with both $n^2$'s being 2.

It will be understood that each $R^{15}$ can optionally be substituted with various groups such as alkoxyl or hydroxyl, or can be branched, but such materials are not preferred herein. In addition $R^{15}$ can optionally be unsaturated (e.g., alkenyl groups).

The above materials used as the fabric softening material in the practice of this invention are prepared using standard reaction chemistry. Disclosure of imidazoline fabric softener materials useful herein can be found in U.S. Pat. Nos.: 4,661,267, Dekker, Konig, Straathof, and Gosselink, issued Apr. 28, 1987; 4,724,089, Konig and Buzzaccarini, issued Feb. 9, 1988; 4,806,255, Konig and Buzzaccarini, issued Feb. 21, 1989; 4,855,072, Trinh, Wahl, Swartley, and Hemingway, issued Aug. 8, 1989; 4,933,096, Demeyere, Hardy, and Konig, issued Jun. 12, 1990; and 4,954,635, Rosario-Jansen and Lichtenwalter, issued Sep. 4, 1990; U.S. Pat. No. 5,013,846, Walley, issued May 7, 1993, all of said patents being incorporated herein by reference in their entirety.

These reaction products are mixtures of several compounds in view of the multifunctional structures of polyamines (see, for example, the publication by H. W. Eckert in Fette-Seifen-Anstrichmittel, September 1972, pages 527–533).

For example, in a typical synthesis of a substituted imidazoline ester softening material of formula (5) above, a fatty acid of the formula $R^{15}COOH$ is reacted with a hydroxyalkylenediamine of the formula $NH_2$—$(CH_2)_n2$—NH—$(CH_2)_n2OH$ to form an intermediate imidazoline precursor, which is then reacted with a methyl ester of a fatty acid of the formula:

$$R^{15}C(O)OCH_3$$

to yield the desired reaction product (wherein $R^{15}$ and $n^2$ are as defined above). It will be appreciated by those of ordinary skill in the chemical arts that this reaction sequence allows a broad selection of materials to be prepared. As illustrative, nonlimiting examples there can be mentioned the following di-alkyl imidazoline compounds (wherein all long-chain alkyl substituents are straight-chain)): 1-stearoyloxyethyl-2-stearyl imidazoline, 1-stearoyloxyethyl-2-palmityl imidazoline, 1-stearoyloxyethyl-2-myristyl imidazoline, 1-palmitoyloxyethyl-2-palmityl imidazoline, 1-palmitoyloxyethyl-2-myristyl imidazoline, 1-stearoyloxyethyl-2-tallow imidazoline, 1-myristoyl oxyethyl-2-tallow imidazoline, 1-palmitoyloxyethyl-2-tallow imidazoline, 1-cocoyloxyethyl-2-coconut imidazoline, 1-tallowyloxyethyl-2-tallow imidazoline, 1-[hydrogenatedtallowylamido]ethyl-2-hydrogenatedtallow imidazoline, 1-[stearylamido]ethyl-2-stearyl imidazoline, 1-[palmityl amido]ethyl-2-palmityl imidazoline, 1-[oleylamido]ethyl-2-oleyl imidazoline, and mixtures of such imidazoline materials.

Other types of substituted imidazoline softening materials can also be used herein. Examples of such materials include:

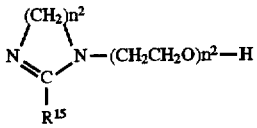

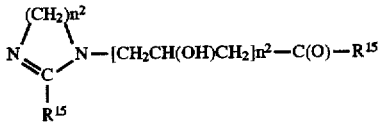

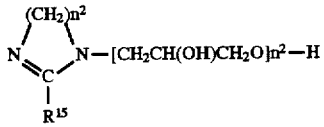

wherein $R^{15}$, and $n^2$ are as previously defined for formula (5). The above list is intended to be illustrative of other types of substituted imidazoline softening materials which can optionally be used in the present invention, but which are not preferred.

Still other preferred fabric softener compounds useful in the compositions of the present invention have the formula:

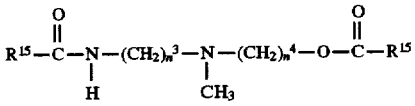

(6)

wherein each $R^{15}$ is independently, hydrocarbyl, preferably alkyl, groups containing from about 11 to about 31, preferably from about 13 to about 17, carbon atoms, more preferably straight chain alkyl groups;

$n^3$ is 1 to 5, preferably 1 to 3; and $n^4$ is 1 to 5, preferably 2.

The compositions of the present invention can also comprise mixtures of softener compounds described hereinabove.

(C) Liquid Carrier and/or Diluent

The liquid carrier and/or diluent employed in the compositions of the present invention is a non-toxic, non-irritating substance which when mixed with the active softener ingredient described hereinbefore, makes the sunscreen compounds more suitable to be deposited onto fabrics by the consumer. The compositions of the present invention comprise from about 25% to about 95%, preferably from about 50% to about 90% of the liquid carrier. Preferably the carrier and/or diluent is primarily water due to its low cost relative availability, safety, and environmental compatibility. The level of water in the liquid carrier is at least about 50%, preferably at least about 60%, by weight of the carrier. Mixtures of water and low molecular weight, e.g., <100, organic solvent, e.g., lower alcohol such as ethanol, propanol, isopropanol or butanol are useful as the carrier liquid. Low molecular weight alcohols include monohydric, dihydric (glycol, etc.) trihydric (glycerol, etc.), and higher polyhydric (polyols) alcohols.

Optional Viscosity/Dispersibility Modifiers

As stated before, relatively concentrated compositions containing both saturated and unsaturated diester quaternary ammonium compounds can be prepared that are stable without the addition of concentration aids. However, the compositions of the present invention may require organic and/or inorganic concentration aids to go to even higher concentrations and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of (1) single long chain alkyl cationic surfactants; (2) nonionic surfactants; (3) amine oxides; (4) fatty acids; and (5) mixtures thereof. These aids are described in P&G Copending application Ser. No. 08/1,142,739, filed Oct. 25, 1993, Wahl et al., specifically on page 14, line 12 to page 20, line 12, which is herein incorporated by reference.

Optional Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. U.S. Pat. No. 4,956,447, Gosselink/Hardy/Trinh, issued Sep. 11, 1990, discloses specific preferred soil release agents comprising cationic functionalities, said patent being incorporated herein by reference in its entirety.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon®4780 (from DuPont) and Milease® T (from ICI).

Highly preferred soil release agents are polymers of the generic formula (I):

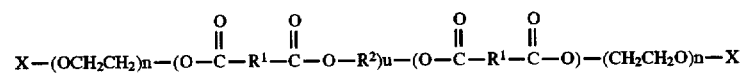

(I)

in which X can be any suitable capping group, with each X being selected from the group consisting of H, and alkyl or acyl groups containing from about 1 to about 4 carbon atoms, preferably methyl. n is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Pat. Application 185,427, Gosselink, published Jun. 25, 1986, incorporated herein by reference.

Optional Bacteriocides

Examples of bacteriocides that can be used in the compositions of this invention are parabens, especially methyl, glutaraldehyde, formaldehyde, 2-bromo-2-nitropropane-1,3-diol sold by Inolex Chemicals under the trade name Bronopol®, and a mixture of 5-chloro-2-methyl-4-isothiazoline-3-one and 2-methyl-4-isothiazoline-3-one sold by Rohm and Haas Company under the trade name Kathon® CG/ICP. Typical levels of bacteriocides used in the present compositions are from about 1 to about 2,000 ppm by weight of the composition, depending on the type of bacteriocide selected. Methyl paraben is especially effective for mold growth in aqueous fabric softening compositions with under 10% by weight of the diester compound.

Other Optional Ingredients

The present invention can include other optional components conventionally used in textile treatment compositions, for example, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, anti-corrosion agents, antifoam agents, and the like.

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the liquid composition is typically from about 0.5% to about 10%, preferably from about 1% to about 5% by weight of the composition.

Preferred nonionic softeners are disclosed in detail in P&G Copending application Ser. No. 08/142,739, filed Oct. 25, 1993, Wahl et al., on page 27, line 23 to page 31, line 11, which this specific section is herein incorporated by reference.

In the method aspect of this invention, fabrics or fibers are contacted with an effective amount, generally from about 10 ml to about 150 ml (per 3.5 kg of fiber or fabric being treated) of the softener compositions herein in an aqueous bath. Of course, the amount used is based upon the judgment of the user, depending on concentration of the composition, fiber or fabric type, degree of softness desired, and the like. Typically, about 20–40 mls of a 23% to a 26% dispersion of softening compounds are used in a 25 gallon laundry rinse both to soften and provide antistatic benefits to a 3.5 kg load of mixed fabrics. Preferably, the rinse bath contains from about 10 to about 1,000 ppm, preferably from about 50 to about 500 ppm, more preferably from abut 70 to about 110 ppm, of the DEQA fabric softening compounds herein, and from about 25 ppm to about 100 ppm, preferably from about 40 to about 65 ppm of the sunscreen compounds herein.

Alternately, the compositions described herein could be used to treat the fabrics by soaking or spraying the compositions, preferably a diluted dispersion, onto the fabrics.

EXAMPLES

The following examples further describe and demonstrate embodiments within the scope of the present invention. The examples are given solely for the purpose of illustration and are not to be construed as limitations of the present invention, as many variations thereof are possible without departing from the spirit and scope of the invention.

Examples I to IV

| Component | I Wt. % | II Wt. % | III Wt. % | IV Wt. % |
|---|---|---|---|---|
| Softener Compound[1] | 8.7 | 8.7 | 8.7 | 8.7 |
| Tinuvin ® 328[2] | 3.0 | 2.5 | 5.0 | |
| Tinuvin ® 571[3] | | | | 3.0 |
| Ethanol | 1.4 | 1.4 | 1.4 | 1.4 |
| $CaCl_2$ | 0.13 | 0.13 | 0.13 | 0.13 |
| Water | Balance | Balance | Balance | Balance |

[1]Di(soft tallowoyloxyethyl)dimethyl ammonium chloride
[2]2-(2'-Hydroxy-3',5'-Di-Tert-Amylphenyl) Benzotriazole available from Ciba Geigy.
[3]2-(2'-Hydroxy 3'-dodecyl 5'-methylphenyl) benzotriazole available from Ciba Geigy.

The above compositions are made by the following procedure: The fabric softener compound (1) in the amount of 6.54 g, ethanol in the amount of 1.06 g and the sunscreen compound are co-melted in an oven heated to 95° C. until the melt is homogeneous. A mixture of 63.43 g water and 0.21 g 1N HCl are heated to 80° C. The acidified water is stirred into the co-melt using a high shear mixer (Ultra-Turrax model T-25) for 1 minute. Subsequently, 5 drops of an aqueous 25% $CaCl_2$ solution is added and the blend is stirred for an additional 1 minute with the high shear mixer. The resulting formulation is allowed to cool to room temperature.

Examples V to VIII

| Component | V Wt. % | VI Wt. % | VII Wt. % | VIII Wt. % |
|---|---|---|---|---|
| Softener Compound 1 | 15.5 | 15.5 | 21.0 | 12.0 |
| Tinuvin ® 328[2] | 7.5 | | | |
| Tinuvin ® 571[3] | | 7.5 | 5.0 | 2.5 |
| Spectra-Sorb ® UV-9[4] | | | | 2.5 |
| Perfume | 0.50 | 1.35 | 1.2 | 0.90 |
| Ethanol | 2.48 | 2.48 | 3.36 | 1.92 |
| $CaCl_2$ | 0.35 | 0.45 | 0.45 | 0.35 |
| Water | 73.67 | 72.72 | 68.99 | 79.83 |

[1]Di(soft tallowoyloxyethyl)dimethyl ammonium chloride
[2]2-(2'-Hydroxy-3',5'-Di-Tert-Amylphenyl)Benzotriazole available from Ciba Geigy.
[3]2-(2'-Hydroxy 3'-dodecyl 5'-methylphenyl) benzotriazole available from Ciba Geigy.
[4]2-hydroxy-4-methoxy-benzophenone available from American Cyanamid.

The above compositions are made by the following procedure: The fabric softener compound (1), ethanol and the sunscreen compound are co-melted in an oven heated to 95° C. until the melt is homogeneous. A mixture of 63.43 g water and 0.21 g 1N HCl are heated to 80° C. The acidified water is stirred into the co-melt using a high shear mixer (Ultra-Turrax model T-25) for 1 minute. Subsequently, 5 drops of an aqueous 25% $CaCl_2$ solution is added and the blend is stirred for an additional 1 minute with the high shear mixer. The resulting formulation is allowed to cool to room temperature.

What is claimed is:

1. A rinse-added fabric softener composition comprising:

A. from about 1% to about 25%, by weight of the composition, of a non-fabric staining, light stable sunscreen compound having the formula:

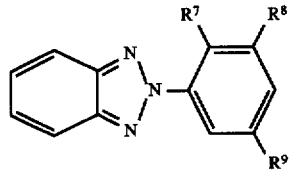

wherein $R^7$ is a hydrogen, hydroxy group, or a $C_1$ to $C_{20}$ alkyl group;

$R^8$ is a hydrogen, hydroxy group, or a $C_1$ to $C_{22}$ alkyl group, which can be an ester, amide, or ether interrupted group having a $C_1$ to $C_4$ alkylene group;

$R^9$ is a hydrogen, hydroxy group, or a $C_1$ to $C_{22}$ alkyl group, which can be an ester, amide, or ether interrupted group having a $C_1$ to $C_4$ alkylene group; and fatty acid derivatives thereof; and B. from about 3% to 50% by weight of the composition of a fabric softening composition selected from the group consisting of:

1. compounds having the formula:

$$[(R^7)_{4-p}-\overset{+}{N}+(CH_2)_{q^2}-(Y')-R^8]_p]\,X^- \quad (1)$$

wherein each Y' is —O—(O)C— or —C(O)—O—;

p is 2 or 3;

each $q^2$ is 1 to 5;

each $R^7$ substituent is selected from short chain $C_1$–$C_6$ alkyl or hydroxyalkyl group, benzyl group and mixtures thereof;

each $R^8$ is a long chain $C_{11}$–$C_{21}$ hydrocarbyl, or substituted hydrocarbyl substituent;

and counterion, $X^-$, is any softener-compatible anion;

2. compounds having the formula:

$$\left[R^8-(Y')-CH_2-\underset{\underset{R^8}{|}}{\underset{(Y')}{\underset{|}{CH}}}-CH_2-\overset{+}{N}-(R^7)_3\right]\ X^- \quad (2)$$

wherein each Y', $R^7$, $R^8$, and X' have the same meanings as before for formula (1);

3. compounds having the formula:

$$\left[R^9-\overset{O}{\overset{\|}{C}}-\overset{H}{\overset{|}{N}}-CH_2CH_2-\underset{\underset{CH_3}{|}}{\overset{R^{10}}{\overset{|}{N^+}}}-CH_2CH_2-\overset{H}{\overset{|}{N}}-\overset{O}{\overset{\|}{C}}-R^9\right]\ X^- \quad (3)$$

wherein each $R^9$ is a $C_8$ to $C_{20}$ alkyl or alkenyl group; $R^{10}$ is a hydrogen methyl, ethyl, or $(C_rH_{2r}O)_sH$, wherein r is from 1 to 5, wherein s is from 1 to 5; and $X^-$ has the same meaning as before for formula (1);

4. compounds having the formula:

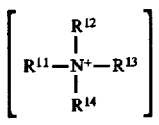

(4)

wherein each $R^{11}$ and $R^{12}$ is a $C_8$–$C_{24}$ alkyl or alkenyl group; each $R^{13}$ and $R^{14}$ is a $C_1$–$C_6$ alkyl group; $X^-$ has the same meaning as before for formula (1);

5. compounds having the formula:

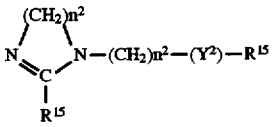

(5)

wherein each $Y^2$ is either: —N($R^{16}$)C(O)—, in which each $R^{16}$ is selected from the group consisting of $C_1$–$C_6$ alkyl, alkenyl, or hydroxy alkyl group, or hydrogen; —OC(O)—; or a single covalent bond;

wherein each $R^{15}$ is independently, a hydrocarbyl group containing from about 11 to about 31 carbon atoms, and wherein each $n^2$ independently is from 2 to 4;

6. compounds having the formula:

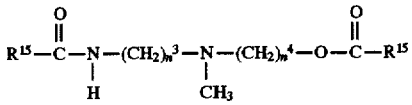

(6)

wherein each $R^{15}$ is independently, a hydrocarbyl group containing from about 11 to about 31 carbon atoms;

$n^3$ is 1 to 5;

$n^4$ is 1 to 5; and 7. mixtures thereof; and

C. from about 25% to about 95% by weight of the composition of a carrier material; and wherein said sunscreen compound absorbs light at a wavelength of from about 290 nm to about 450 nm and is a solid compound having a melting point of from about 25° C. to about 90° C., or a viscous liquid at a temperature of less than about 40° C.

2. The composition of claim 1 wherein the sunscreen compound has at least one $C_8$ to $C_{22}$ hydrocarbon fatty organic moiety.

3. The composition of claim 1 wherein the sunscreen compound absorbs light at a wavelength of from about 315 nm to about 400 nm.

4. The composition of claim 3 wherein the sunscreen compound is a solid having a melting point of from about 25° C. to about 75° C.

5. The composition of claim 4 wherein the sunscreen compound is a solid having a melting point of from about 25° C. to about 50° C.

6. The composition of claim 1 wherein the sunscreen compound is from about 2% to about 20% by weight of the composition.

7. The composition of claim 6 wherein the sunscreen compound is from about 3% to about 15% by weight of the composition.

8. The composition of claim 1 wherein the sunscreen compound is selected from the group consisting of 2-(2'-Hydroxy, 3'-dodecyl, 5'-methylphenyl) benzotriazole, Coco 3-[3'-(2H-benzotriazol-2'-yl)-5-tert-butyl-4'-hydroxyphenyl]propionate, and mixtures thereof.

9. The composition of claim 1 wherein the fabric softening composition is a diester quaternary ammonium compound of the formula:

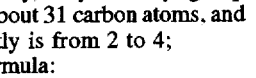

(1)

wherein each Y' is —O—(O)C—, or —C(O)—O—;

p is 2 or 3;

each $q^2$ is 1 to 5, each $R^7$ substituent is a short chain $C_1$–$C_6$, alkyl or hydroxyalkyl group, benzyl group and mixtures thereof;

each $R^8$ is a long chain $C_{11}$–$C_{21}$ hydrocarbyl, or substituted hydrocarbyl substituent, and counterion, $X^-$, can be any softener-compatible anion.

10. The composition of claim 9 wherein Y' is —O—(O)C—, $q^2$ is 2, p is 2, $R^7$ is a $C_1$–$C_3$ alkyl group, and $R^8$ is a $C_{15}$–$C_{19}$ alkyl group.

11. The composition of claim 9 wherein the fabric softening compound is from about 6% to about 32% by weight of the composition.

12. The composition of claim 1 wherein $R^7$ is a hydrogen or a hydroxy group; $R^8$ is a $C_1$ to $C_8$ alkyl group; and $R^9$ is a tert-amyl group, methyl phenyl group, or a coco dimethyl butanoate group.

13. A method to decrease the fading of fabrics from sunlight by adding an effective amount of the composition of claim 1 to the rinse cycle of a textile laundering process.

* * * * *